US010538713B1

(12) United States Patent
Willigan

(10) Patent No.: US 10,538,713 B1
(45) Date of Patent: Jan. 21, 2020

(54) PROCESS AND CHEMISTRY FOR FORMULATING MAGNESIUM TREATED BORON POWDER INTO A COMBUSTIBLE SLURRY FUEL

(71) Applicant: United Technologies Corporation, Farmington, CT (US)

(72) Inventor: Rhonda R. Willigan, Manchester, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 183 days.

(21) Appl. No.: 15/600,012

(22) Filed: May 19, 2017

(51) Int. Cl.
*C10L 1/04* (2006.01)
*C10L 1/12* (2006.01)

(52) U.S. Cl.
CPC ..... *C10L 1/04* (2013.01); *C10L 1/12* (2013.01); *C10L 1/1208* (2013.01); *C10L 1/1216* (2013.01); *C10L 1/1233* (2013.01); *C10L 2200/0213* (2013.01); *C10L 2200/0254* (2013.01); *C10L 2270/04* (2013.01)

(58) Field of Classification Search
CPC ..... C10L 1/04; C10L 1/12; C10L 2200/0213; C10L 2200/0254; C10L 2270/04; C10L 1/1216; C10L 1/1208; C10L 1/1233
See application file for complete search history.

(56) References Cited

U.S. PATENT DOCUMENTS 3,019,145 A * 1/1962 Whitby ..... C10L 1/1208 149/87
3,567,531 A * 3/1971 Fuller ..... B01J 19/06 149/108.2
4,157,242 A * 6/1979 Tarpley, Jr. ..... C10L 1/322 44/265
4,683,126 A * 7/1987 Inoue ..... C01B 35/126 423/279
5,505,867 A * 4/1996 Ritter ..... C10L 1/10 508/400
5,586,729 A * 12/1996 Davenport ..... B02C 7/04 241/21
2005/0016061 A1* 1/2005 Allen ..... C10L 1/1233 44/457
2007/0056212 A1* 3/2007 Fink ..... C10L 1/00 44/309
2008/0318816 A1* 12/2008 Sandu ..... C10L 1/14 508/306

(Continued)

FOREIGN PATENT DOCUMENTS

CN 101628199 A 1/2010

OTHER PUBLICATIONS

Liehmann; "Combustion of Boron-Based Slurries in a Ramburner"; Combustion of Boron-Based Solid Fuels alld Slurries; Fraunhofer-Institut für Chemische Technologie D-7507 Pfinztal, FRG, 1985, pp. 353-359.

(Continued)

*Primary Examiner* — Pamela H Weiss
(74) *Attorney, Agent, or Firm* — Cantor Colburn LLP

(57) ABSTRACT

Disclosed herein is a fuel blend comprising a hydrocarbon based fuel; and particles that comprise magnesium and boron. Disclosed herein too is a method comprising blending a composition comprising a hydrocarbon based fuel and particles that comprise magnesium and boron to form a fuel blend.

15 Claims, 2 Drawing Sheets

(56) References Cited

U.S. PATENT DOCUMENTS

| | | | | |
|---|---|---|---|---|
| 2009/0000186 | A1* | 1/2009 | Sanders | C10L 1/10 44/321 |
| 2011/0130313 | A1* | 6/2011 | Hughes | C10M 125/26 508/155 |
| 2012/0234196 | A1* | 9/2012 | Beck | F41A 1/04 102/374 |
| 2014/0210947 | A1* | 7/2014 | Finn | G01C 15/002 348/46 |
| 2014/0227548 | A1* | 8/2014 | Myrick | C06B 45/30 428/570 |

OTHER PUBLICATIONS

Yeh et al.; "Ignition and Combustion of Boron Particles"; Prog. Energy Combwl. Sci ;vol. 22; 1996, pp. 511-541.

E, Xiu-tian-feng et al.; "Jet fuel containing ligand-protecting energetic nanoparticles:A case study of boron in JP-10"; Chemical Engineering Science; 129; 2015, pp. 9-13.

Li et al.; "Effect of Carbon Dioxide on the Reactivity of the Oxidation of Boron Particles"; Propellants Explos. Pyrotech.; 39, 2014, pp. 617-623.

Shumaila et al.; "A study on the synthesis, characterization and properties of polyaniline/magnesium boride nanocomposites"; Polym Int; 63; 2014, pp. 1465-1470.

Yeh et al.; "Experimental Studies of Boron Particle Combustion"; Transport Phenomena in Combustion, vol. 2; 1996, pp. 1461-1472.

* cited by examiner

PROCESS AND CHEMISTRY FOR FORMULATING MAGNESIUM TREATED BORON POWDER INTO A COMBUSTIBLE SLURRY FUEL

STATEMENT OF FEDERAL SUPPORT

This invention was made with government support under HR0011-15-C-0101 awarded by the Department of the Defense Advanced Research Projects Agency. The government has certain rights in the invention.

BACKGROUND

The present disclosure relates to slurry fuel with magnesium treated boron and associated manufacturing processes therefor.

Increased range for disposable aerospace vehicles such as air launched decoys and cruise missiles that utilize air-breathing turbine power plants is of interest as the increased range enables larger stand-off distances. The Bregüet equation suggests three possible ways to increase range: (1) increasing the energy of aviation fuels, (2) increasing the lift-drag (L/D) ratio, and/or (3) increasing the amount of fuel carried. Of these three strategies, L/D poses redesign problems that cannot be solved in the near term. Similar problems apply to the third strategy where, for example, external fuel tanks are added. This reduces L/D, maneuverability and compromises the vehicle's signature. An attractive way to increase range therefore includes formulating new fuels, with a higher potential energy that are relatively easy to ignite and capable of efficiently burning.

SUMMARY

Disclosed herein is a fuel blend comprising a hydrocarbon based fuel; and particles that comprise magnesium and boron.

In an embodiment, the particles are present in an amount of 0.5 to 60 wt %, based on a total weight of the fuel blend, where the fuel blend comprises a suspension of the particles in the hydrocarbon based fuel.

In another embodiment, the fuel blend comprises a slurry of the particles and the hydrocarbon based fuel.

In another embodiment, the hydrocarbon based fuel may have a carbon number distribution between about 5 and 16 and comprises alkylbenzenes, alkylnaphthalenes, olefins, and branched and straight chain alkanes and naphthenes.

In yet another embodiment, the hydrocarbon based fuel comprises alcohol based fuels, gasoline, diesel, kerosene, or a combination thereof.

In an embodiment, the magnesium and boron is present in a single particle having a formula of $MgB_x$, where x is an integer from 1 to 12. The particle further comprises boron particles and magnesium oxide particles.

In yet another embodiment, the particles have an average particle size of 10 nanometers to 5 micrometers prior to being incorporated into the fuel blend.

In an embodiment, a portion of the particles have an average particle size from 10 to 100 nanometers after being incorporated into the fuel blend and this portion of the particles are suspended in the hydrocarbon based fuel.

In an embodiment, the particles comprise magnesium in an amount of 14 to 28 wt %, and boron in an amount of 70 to 90 wt %, based on the total weight of the particles.

In an embodiment, the particles are present in an amount of 47 to 52 wt %, based on the total weight of the fuel blend.

In an embodiment, the fuel blend further comprises at least one of a surfactant and a dispersant.

In an embodiment, the surfactant comprises succinimides, poly-isobutylene succinimide, octylamine, trioctylamine, sorbitan trioleate, a non-ionic surfactant that includes hydrophilic polyethylene oxide chains on a hydrocarbon oleophilic group, or a combination thereof and the surfactant is present in an amount of 1 to 15 wt %, based on a total weight of the fuel blend.

In an embodiment, the dispersant comprises $CaCO_3$ microcrystals "coated" with an alkylsulfonate wetting agent and the dispersant is present in an amount of 1 to 15 wt %, based on a total weight of the fuel blend.

In an embodiment, the fuel blend has a gravimetric energy density of 45 to 51 kilojoules per gram as determined via a static bomb calorimetry test.

In an embodiment, the fuel blend has a solution viscosity of 10 to 200 centipoise when measured using a Brookfield viscometer at room temperature and pressure.

Disclosed herein too is a method comprising blending a composition comprising a hydrocarbon based fuel and particles that comprise magnesium and boron to form a fuel blend.

In an embodiment, the blending includes shearing the composition to reduce particle size.

In yet another embodiment, the blending further includes adding a surfactant and a dispersant to the composition.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
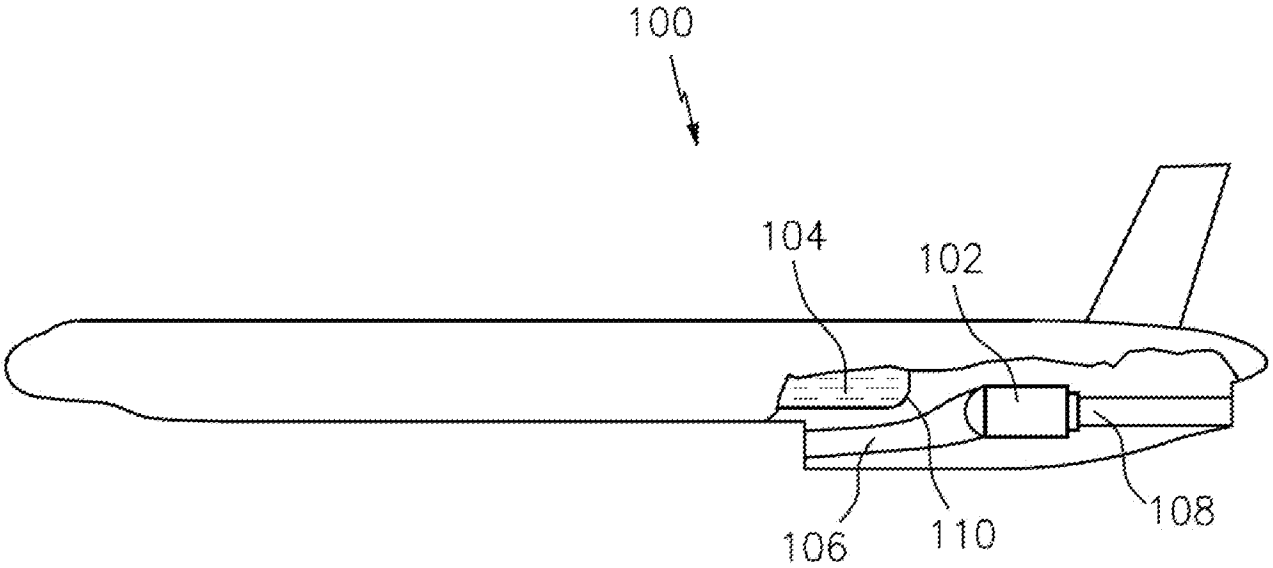
FIG. 1 is a partially schematic cross-sectional view of a vehicle carrying a fuel blend.

FIG. 1 is a partially schematic cross-sectional view of an aerospace vehicle 100 such as an air launched decoy, cruise missile, Unmanned Air Vehicle (UAV) that utilizes an air-breathing power plant 102 and carries a fuel blend 104 in accordance with embodiments herein. In an embodiment, the fuel blend 104 comprises a hydrocarbon based fuel that has particles of flammable magnesium based powder disposed in it. The air-breathing power plant 102 may alternatively include a turbojet, turbofan, ramjet engine, or other motor for use in a manned vehicle as well.

The air-breathing power plant 102 receives air through an inlet 106 and produces power in the form of thrust through an exhaust 108 by burning the fuel blend 104 using oxygen available from the atmospheric air that flows through the inlet 106. The fuel blend 104 can be stored in a tank 110 carried by the vehicle 100 and delivered to the air-breathing power plant 102 as a pumpable, injectable, combustible mixture. In certain embodiments, the combustion or oxidation of the fuel blend 104 provides performance benefits for the aerospace vehicle 100 over existing fuels.

The fuel blend can include a hydrocarbon based fuel mixed with particles of the powder (hereinafter particles) to increase the flammability and combustibility of the fuel. The fuel blend can exist in the form of a suspension, a slurry, or combination of a suspension and a slurry. In an embodiment, when the fuel blend is in the form of a slurry, portions of it may be re-agitated to form a suspension. In general, the fuel blend displays a good room temperature shelf stability and the particles can remain suspended in the fuel blend for a period greater than 30 minutes, greater than 1 hour, preferably greater than 1 day, more preferably greater than 2 days, more preferably greater than 7 days, and more preferably greater than 1 month.

In an embodiment, the hydrocarbon based fuel may have a carbon number distribution between about 5 and 16 and can include branched and straight chain alkanes and naphthenes (cycloalkanes), alkylbenzenes (single ring), alkylnaphthalenes (double ring), and olefins. The hydrocarbon based fuel can include various alcohol based fuels, gasoline, diesel, kerosene, or a combination thereof. In an embodiment, the hydrocarbon based fuel can include JP-4 (e.g., a kerosene-gasoline blend), JP-5 (e.g., hydrocarbons comprising alkanes, naphthenes, and aromatic hydrocarbons), JP-7 (e.g., a mixed compound comprising different hydrocarbons (i.e., alkanes, cycloalkanes, alkylbenzenes, indan/tetralins, and naphthalenes), JP-8 (e.g., a kerosene based fuel comprising a plurality of different hydrocarbons, such as, for example, up to 100 hydrocarbons), JP-10 (e.g., a fuel that comprises exo-tetrahydrodicyclopentadiene), Jet A (e.g., kerosene (C9-C16) and naphthalene), or a combination thereof. In an embodiment, kerosene is the preferred hydrocarbon based fuel. In another embodiment, JP-10 is the preferred hydrocarbon based fuel.

The hydrocarbon based fuel is of a type and present in an amount sufficient to preferably promote suspension of the particles in the fuel blend. In an embodiment, the particles may be present in an amount that renders the fuel blend slurry-like. Whether present in the form of a slurry or in the form of a suspension, it is desirable for the fuel blend to be flowable under its own weight at room temperature. In an embodiment, it is desirable for the fuel blend to have a viscosity that permits it to be pumpable. The hydrocarbon based fuel may be used in amounts of 40 to 99.5 wt %, preferably 45 to 75 wt %, and more preferably 48 to 60 wt %, based on the total weight of the fuel blend. In an exemplary embodiment, the hydrocarbon based fuel may be used in amounts of 48 to 53 wt %, based on the total weight of the fuel blend.

The particles that increase the ignitability and combustibility of the fuel blend comprise a mixture of boron particles, magnesium boride ($MgB_x$) particles and magnesium oxide particles. The presence of magnesium improves the combustibility of the fuel blend. The magnesium enables "light off" or "ignition" of the boron and provides a lower ignition temperature than boron (i.e., magnesium ignites at a temperature of 700° C. vs. 1700° C. for the boron). Magnesium burns with approximately 1.6 times higher energy content than boron. In an embodiment, the addition of the particles to the hydrocarbon based fuel increases the gravimetric energy density of the fuel blend by an amount of greater than 10%, and preferably greater than 20% over the gravimetric energy density of the hydrocarbon based fuel.

In an embodiment, the gravimetric energy density of the fuel blend is 45 to 51 kilojoules per gram, preferably 47 to 50 kilojoules per gram as determined via a bomb calorimetry test. The bomb calorimetry test is conducted inside a standard, static bomb calorimeter with the fuel blend. The samples tested were either (a) a mixture of Mg—B powder with paraffin wax, or (b) the fuel blend with no other additions. There was no mixing of (a) and (b) during the test. The atmosphere inside the bomb calorimeter was not inerted. In other words, the standard ambient atmosphere was used without the use of an inert gas. The bomb is then externally heated. For the powder/paraffin wax mixture, because the energy release of the paraffin wax is known and since the composition of the Mg—B powder is known, the total energy release for the sample can be used to back calculate the energy release of the Mg—B component alone.

The particles in one embodiment include a magnesium treated boron powder (e.g., Mg/B powder) and comprise a mixture of boron particles, magnesium boride ($MgB_x$) particles and magnesium oxide particles. The magnesium boride may include integer values of x of 1 to 12, which can include values of 1, 2, 3, 4, 5, 6, 7, 8, 9, 10, 11 and 12. Magnesium diboride ($MgB_2$) particles may be present in larger amounts than the other magnesium boride particles (the particles where x is not equal to 2). The particles may also exist in the form of agglomerates. An agglomerate is a loose collection of particles. The agglomerates may have average sizes of 2 to 50 micrometers.

The particles can have an average particle size in the nanometer (less than or equal to about 100 nanometers) and micrometer (greater than 100 nanometers) size range in the fuel blend. The particle size is determined by a cross-sectional dimension (e.g., a radius of gyration). The particle size distribution may be unimodal of multi-modal (e.g., bimodal or trimodal). Smaller particle sizes and small particle size distributions are preferred as these permit the suspension of the particles in the hydrocarbon based fuel.

In an embodiment, the particle has an average particle size of 10 nanometers to 5 micrometers, preferably 20 nanometers to 1.0 micrometers, and more preferably 50 nanometers to 0.7 micrometers prior to being incorporated into the fuel blend.

In an embodiment, it is desirable for the average particle sizes of a portion of the particles to be in the nanometer size range and to be less than 100 nanometers. The average particle sizes may therefore be 10 to less than 100 nanometers, preferably 20 to 80 nanometers, and more preferably 30 to 70 nanometers after being incorporated into the fuel blend. Particles in the nanometer size range will generally remain in suspension and will tend not to drop out of solution.

The ratio of magnesium to boron to oxygen in the particles can determine the gravimetric energy density of the particles and determine the efficiency with which the fuel blend burns. This ratio can be altered to increase the energy density (by using greater amounts of boron) or facilitate a more facile ignition (by using greater amounts of Mg). The magnesium can be present in an amount of 14 to 28 weight percent (wt %), preferably 15 to 20 wt %, based on the total weight of the particles. The boron can be present in an amount of 70 to 90 wt %, preferably 72 to 80 wt %, based on the total weight of the particles. The oxygen can be present in an amount of 3 to 10 wt %, preferably 5 to 9 wt %, based on the total weight of the particles.

The particles may be present in the fuel blend in an amount of 0.5 to 60 wt %, preferably 25 to 55 wt %, and more preferably 40 to 52 wt %, based on the total weight of the fuel blend. In an exemplary embodiment, the particles may be used in amounts of 47 to 52 wt %, based on the total weight of the fuel blend.

The fuel blend may contain other optional additives in addition to the hydrocarbon based fuel and the particles. These additives may include surfactants and dispersants. The surfactants and the dispersants facilitate retaining the particles in suspension over extended periods of time. This reduces the viscosity of the blend and improves the shelf life of the fuel blend making it transportable during use in the aircraft as well during storage.

The surfactants include nonionic, cationic, anionic and zwitterionic surfactants that can be electron donating or electron accepting and can include cyclic, linear, or branched molecules. Many long chain alcohols exhibit some surfactant properties. Prominent among these are the fatty alcohols, cetyl alcohol, stearyl alcohol, and cetostearyl alcohol (consisting predominantly of cetyl and stearyl alcohols), and oleyl alcohol. Examples include polyethylene glycol alkyl ethers, octaethylene glycol monododecyl ether, pentaethylene glycol monododecyl ether, polypropylene glycol alkyl ethers, glucoside alkyl ethers, decyl glucoside, lauryl glucoside, octyl glucoside, polyethylene glycol octylphenyl ethers, Triton X-100, Tween-80, polyethylene glycol alkylphenyl ethers, Nonoxynol-9, glycerol alkyl esters, glyceryl laurate, polyoxyethylene glycol sorbitan alkyl esters, polysorbate, sorbitan alkyl esters, sorbitan trioleate, cocamide MEA, cocamide DEA, dodecyldimethylamine oxide, block copolymers of polyethylene glycol and polypropylene glycol, poloxamers, polyethoxylated tallow amine (POEA), or a combination thereof.

Anionic surfactants contain anionic functional groups at their head, such as sulfate, sulfonate, phosphate, and carboxylates. Cationic surfactants include pH-dependent primary, secondary, or tertiary amines. Zwitterionic (amphoteric) surfactants have both cationic and anionic centers attached to the same molecule. The cationic part is based on primary, secondary, or tertiary amines or quaternary ammonium cations. The anionic part can be more variable and include sulfonates, as in the sultaines CHAPS (3-[(3-Cholamidopropyl)dimethylammonio]-1-propanesulfonate) and cocamidopropyl hydroxysultaine. Betaines such as cocamidopropyl betaine have a carboxylate with the ammonium. The most common biological zwitterionic surfactants have a phosphate anion with an amine or ammonium, such as the phospholipids phosphatidylserine, phosphatidylethanolamine, phosphatidylcholine, and sphingomyelins.

Preferred surfactants include succinimides, poly-isobutylene succinimide (e.g., Chevron product OLOA11000), octylamine, trioctylamine, Tween-80, S-49, sorbitan trioleate, non-ionic surfantants that include hydrophilic polyethylene oxide chains on a hydrocarbon oleophilic group.

The surfactant is added to the fuel blend in an amount of 1 to 15 wt %, preferably 2 to 10 wt %, and more preferably 3 to 8 wt %, based on the total weight of the fuel blend.

The dispersant includes calcium sulfonate compound, which comprises $CaCO_3$ microcrystals "coated" with an alkylsulfonate wetting agent to provide a "thickening" function to prevent setting. Carboxylic acids may also be used as surfactants. Examples of unsaturated carboxylic acids are maleic acid, fumaric acid, itaconic add, acrylic acid, methacrylic acid, crotonic acid, and citraconic acid. Examples of derivatives of unsaturated carboxylic acids are maleic anhydride, citraconic anhydride, itaconic anhydride, methyl acrylate, methyl methacrylate, ethyl acrylate, ethyl methacrylate, butyl acrylate, butyl methacrylate, glycidyl acrylate, glycidyl methacrylate, or the like, or a combination thereof. Maleic anhydride is the preferred carboxylic acid.

The anti-particle setting agent is shear thinning in nature, so any thickening of the slurry that occurs upon preparation will dissipate upon shear. The dispersant is added to the fuel blend in an amount of 1 to 10 wt %, preferably 2 to 8 wt %, and more preferably 3 to 6 wt %, based on the total weight of the fuel blend.

In an embodiment, a process for manufacturing the fuel blend initially includes adding the hydrocarbon based fuel, the particles, the optional surfactant and the optional dispersant to a mixing vessel. The ingredients are mixed at a high rate of shear to form the fuel blend. The mixing is conducted for a time period and at a temperature effective to reduce the particle size and the agglomerate size so that the viscosity of the fuel blend is 10 to 200 centipoise when measured using a Brookfield viscometer at room temperature and pressure. The viscosity of the fuel blend was calculated as follows. A SSA, or small sample adapter set was used consisting of Brookfield part #SC4-27, pack of 100, single use, disposable spindles, and Brookfield part #SC4-13RD sample chamber, also single use, disposable, pack of 100. The sample was placed in the disposable sample chamber and the disposable spindle was then rotated to determine the viscosity of the sample.

In one embodiment, the ingredients are all added simultaneously to the mixing device and the mixing is conducted for a period of time effective to form the fuel blend. In another embodiment, the ingredients may be added sequentially to the mixing device to form the fuel blend. For example, the hydrocarbon based fuel and the dispersants (e.g., the surfactant) may be first blended together followed by adding the particles to the mixture of the fuel and dispersants. After mixing for a period of time, the surfactant and/or the dispersant may be added to the mixing device. The mixing device may be a batch or a continuous mixer.

The shearing of the ingredients may be conducted in a variety of different devices and may involve the use of shear force, extensional force, compressive force, ultrasonic energy, electromagnetic energy, thermal energy or combinations comprising at least one of the foregoing forces or forms of energy and is conducted in processing equipment wherein the aforementioned forces or forms of energy are exerted by a single screw, multiple screws, intermeshing co-rotating or counter rotating screws, non-intermeshing co-rotating or counter rotating screws, reciprocating screws, screws with pins, screws with screens, barrels with pins, rolls, rams, helical rotors, or combinations comprising at least one of the foregoing.

Mixing involving the aforementioned forces may be conducted in machines such as single or multiple screw extruders, Buss kneader, Henschel, helicones, Ross mixer, Banbury, roll mills, Polytron mixing units, Megatron mixing units, or the like, or combinations comprising at least one of the foregoing machines.

The mixing is preferably conducted at a temperature of −10° C. to 75° C., preferably 10° C. to 50° C. at a rotor speed of 100 to 40,000 revolutions per minute, preferably 300 to 25,000 revolutions per minute, and more preferably 500 to 20,000 revolutions per minute.

In an exemplary embodiment, the high shear mixing system may include a flow-through Megatron mixing unit for performing the high shear mixing operating at 30,000 revolutions per minute (rpm), coupled with a coiled ethylene glycol cooling loop, for removal of heat generated during the shearing process. A supply tank, with a valve at the bottom for gravity feeding the ingredients into the Megatron unit, and a receiving tank for metering the suspension after being sheared and cooled through the ethylene glycol loop. An overhead paddle stirrer may be used to continuously swipe the side of the tank to prevent buildup on the interior of the tank, while providing an upward mixing motion to maintain the ingredients in an agitated state during processing. While an in-line flow through mixer such as the Megatron mixing unit ensures that the ingredients gets sheared and processed homogenously, batch mixers can also be used to produce homogeneous slurries at 8,000 rpm and as low as 900 rpm, provided the process is getting enough rigorous mixing and flow.

The mixing de-agglomerates and decreases the size of the particles. Compared to the dry starting powder, the particles after high shear mixing are at least one or more orders of magnitude smaller in particle size. The high shear mixing also promotes a better dispersion of the surfactant and facilitates contact between the particles and the surfactant. The high shear mixing thus promotes the formation of improved suspensions by reducing particle size and by establishing better contact between the surfactant and the particles.

The mixing of the ingredients in the high shear mixer produces a suspension, a slurry, or a combination of a suspension or a slurry that has a viscosity of 15 to 220 centipoise (cP), preferably 50 to 175 cP, and more preferably 90 to 120 cP using a Brookfield viscometer at standard temperature and pressure.

It is desirable for the particles to remain suspended in the suspension or the slurry for as long as possible. While the slurry may contain some percentage of particles that are not in suspension, it is to be noted that the remaining percentage will be in suspension and it is desirable for these particles to remain in suspension for as long as possible. In an embodiment, it is desirable for at least 10% of the particles to remain in suspension for a period of greater than 5 hours, preferably at least 30% of the particles to remain in suspension for a period of greater than 5 hours, preferably at least 50% of the particles to remain in suspension for a period of greater than 5 hours, and more preferably at least 90% of the particles to remain in suspension for a period of greater than 5 hours. In another embodiment, it is desirable for at least 30% of the particles to remain in suspension for a period of greater than 5 days, preferably at least 50% of the particles to remain in suspension for a period of greater than 5 days, preferably at least 70% of the particles to remain in suspension for a period of greater than 5 days, and more preferably at least 80% of the particles to remain in suspension for a period of greater than 5 days.

The invention is exemplified by the following non-limiting example.

EXAMPLE

This example was conducted to determine variations in viscosity of the fuel blend with different amounts of the particles. A fuel blend comprising from 25 to 50 wt % of the particles was manufactured using the flow-through Megatron mixing unit listed above.

The resulting fuel blend at 25 to 50 weight percent particle load, exhibited a reasonable solution viscosity of 90 to 120 cP using a Brookfield viscometer at standard temperature and pressure. The viscosity of the slurry is measured using a Brookfield viscometer at standard temperature and pressure by placing the slurry into an aluminum thimble and then immersing a metal spindle into the slurry at a set rotational speed to measuring the resistance to spin. The instrument then converts the rotational speed into a viscosity value. Calibration fluids across a range of viscosities are used to quality check the output from the instrument and the spindles are calibrated through an internal equipment process before measuring the actual slurry. In addition to measuring the calibration fluids with known viscosities, the base fuel that was used in the slurry was also measured periodically to ensure it measured according to its known, expected value. Measurements were also taken across a range of rotational speeds that the spindle was set to spin at. Measurements were made, for the most part, at room temperature.

Figure 2:
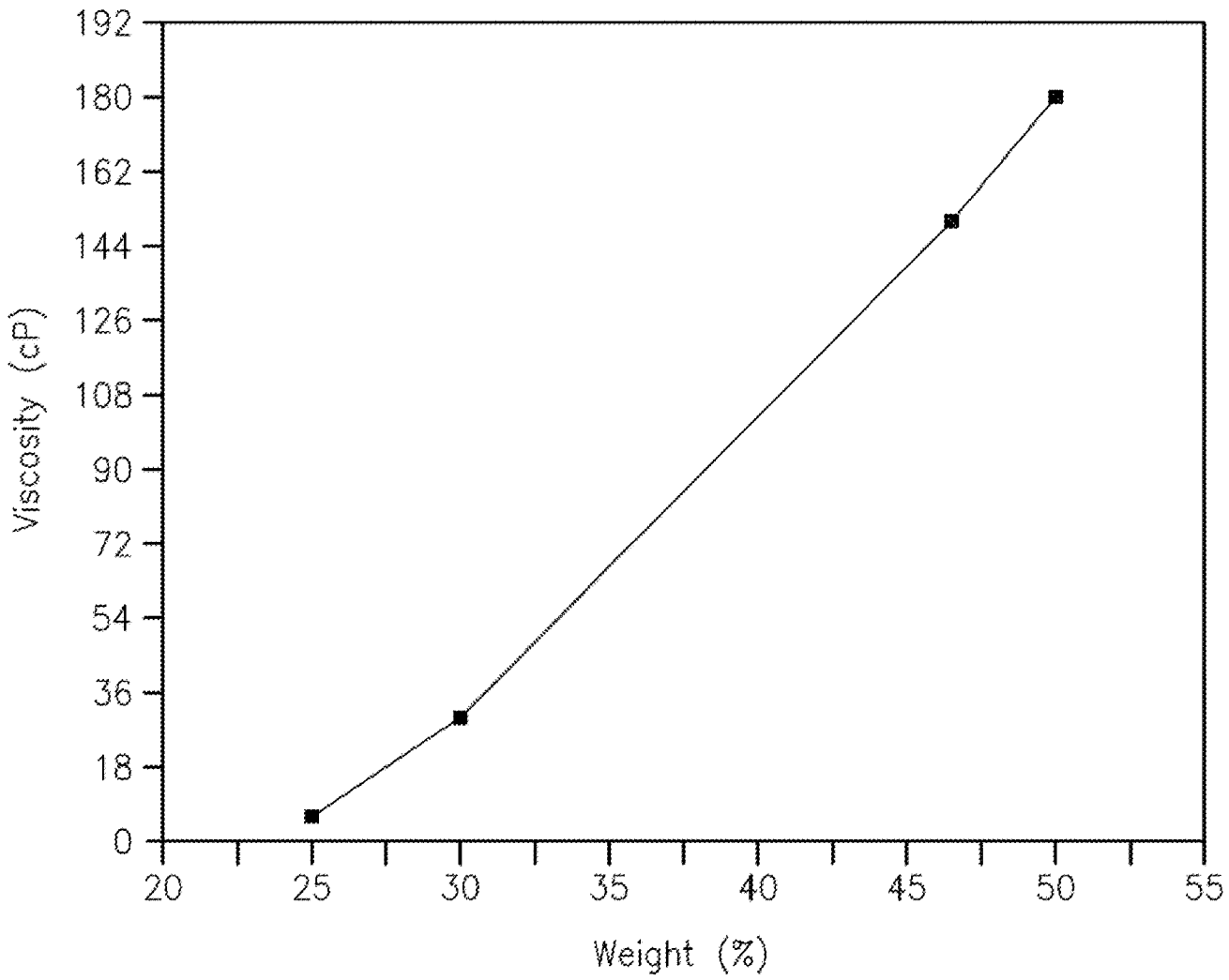
FIG. 2 is a graph illustrating a viscosity vs weight percent of the fuel blend.

The hydrocarbon based fuel used in this example is JP-10. The graph in the FIG. 2 depicts the increase in viscosity with particle loading. From the graph it may be seen that as the particulate loading in the fuel blend increases the viscosity of the fuel blend also increases. The viscosity increases from 90 cP at 25 wt % particle loading to 120 cP at 50 wt % particle loading. JP-10 has a solution viscosity of 10 cP using the Brookfield viscometer as detailed above at standard temperature and pressure.

These samples were also tested to determine shelf life and room temperature stability. It was determined that a fuel blend containing 50 wt % of the particles can have a majority of the particles stay in suspension for 5 or more days. In an embodiment, it was discovered that 82% of particles remain suspended after 5 days. This compares favorably with the time to undertake a mission which may be around 45 to 60 minutes. In one experiment, the fuel blend generally has a density of 1.1 to 1.4 grams per milliliter (g/mL), when all particles remain in suspension.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason, the appended claims should be studied to determine true scope and content.

What is claimed:

1. A fuel blend comprising:

a hydrocarbon based fuel; and a particulate mixture of boron particles, magnesium boride particles and magnesium oxide particles;

where the magnesium is present in an amount of 14 to 28 wt. %, and where the boron is present in an amount of 70 to 90 wt. % based on the total weight of the particulate mixture;

where the particulate mixture is present in an amount of 47 to 52 wt. % based on the total weight of the fuel blend.

2. The fuel blend of claim 1, where the fuel blend comprises a slurry of the particulate mixture and the hydrocarbon based fuel.

3. The fuel blend of claim 1, where the hydrocarbon based fuel has a carbon number distribution between about 5 and 16 and comprises branched and straight chain alkanes and naphthenes, alkylbenzenes, alkylnaphthalenes and olefins.

4. The fuel blend of claim 1, where the hydrocarbon based fuel comprises alcohol based fuels, gasoline, diesel, kerosene, or a combination thereof.

5. The fuel blend of claim 1, where the magnesium boride particles comprise $MgB_x$ particles, where x is an integer from 1 to 12.

6. The fuel blend of claim 1, where the particulate mixture has an average particle size of 10 nanometers to 5 micrometers prior to being incorporated into the fuel blend.

7. The fuel blend of claim 1, where a portion of the particulate mixture has an average particle size of 10 nanometers to less than 100 nanometers after being incorporated into the fuel blend and where this portion of the particles are suspended in the hydrocarbon based fuel.

8. The fuel blend of claim 1, further comprising at least one of a surfactant and a dispersant.

9. The fuel blend of claim 8, where the surfactant comprises succinimides, poly-isobutylene succinimide, octylamine, trioctylamine, sorbitan trioleate, a non-ionic surfactant that includes hydrophilic polyethylene oxide chains on a hydrocarbon oleophilic group, or a combination thereof, and where the surfactant is present in an amount of 1 to 15 wt %, based on a total weight of the fuel blend.

10. The fuel blend of claim 8, where the dispersant comprises $CaCO_3$ microcrystals coated with an alkylsulfonate wetting agent, and where the dispersant is present in an amount of 1 to 15 wt %, based on a total weight of the fuel blend.

11. The fuel blend of claim 1, where the fuel blend has a gravimetric energy density of 45 to 51 kilojoules per gram as determined via a bomb calorimetry test.

12. The fuel blend of claim 1, where the fuel blend has a solution viscosity of 10 to 200 centipoise when measured using a Brookfield viscometer at room temperature and pressure.

13. A method comprising:

blending a composition comprising a hydrocarbon based fuel and a particulate mixture of boron particles, magnesium boride particles and magnesium oxide particles to form a fuel blend;

where the magnesium is present in an amount of 14 to 28 wt. %, and where the boron is present in an amount of 70 to 90 wt. % based on the total weight of the particulate mixture;

where the particulate mixture is present in an amount of 47 to 52 wt. % based on the total weight of the fuel blend.

14. The method of claim 13, where the blending includes shearing the composition to reduce particle size.

15. The method of claim 13, where the composition further comprises a surfactant and a dispersant.

* * * * *